United States Patent [19]

Mihos

[11] 3,993,372

[45] Nov. 23, 1976

[54] OVERHEAD CIGARETTE RACK

[76] Inventor: Peter Mihos, 278 Spring St., Brockton, Mass. 01401

[22] Filed: July 25, 1975

[21] Appl. No.: 599,121

[52] U.S. Cl. ..... 312/42; 312/45; 211/49 D

[51] Int. Cl.[2] ..... A47F 1/00; A47F 7/00

[58] Field of Search ..... 312/42, 45; 211/49 D

[56] References Cited

UNITED STATES PATENTS

| | | | |
|---|---|---|---|
| 1,117,148 | 11/1914 | Amberg et al. | 312/45 |
| 1,435,935 | 11/1922 | Malacos | 312/42 |
| 1,673,812 | 6/1928 | Dunn | 312/42 |
| 1,912,344 | 5/1933 | Chisholm | 312/45 |
| 1,999,021 | 4/1935 | Marsh | 312/42 |
| 2,272,682 | 2/1942 | Srodulski | 312/42 |
| 2,350,487 | 6/1944 | Bales | 312/45 X |
| 2,723,036 | 11/1955 | Temple | 312/42 |
| 3,393,797 | 7/1968 | Flood | 312/45 |
| 3,587,925 | 6/1971 | Keller | 312/45 |
| 3,923,159 | 12/1975 | Taylor | 211/49 D |

FOREIGN PATENTS OR APPLICATIONS

| | | | |
|---|---|---|---|
| 1,104,110 | 11/1955 | France | 312/42 |

*Primary Examiner*—Paul R. Gilliam
*Assistant Examiner*—Victor N. Sakran
*Attorney, Agent, or Firm*—Wolf, Greenfield & Sacks

[57] ABSTRACT

A display and vending device for stackable articles such as cigarette packages or the like is suspended from overhead supports, for example, at the check-out counter of a retail store. The articles contained in the device are accessible only to the cashier but are visible to the customer. The device includes a frame having a plurality of vertical dividers which separate the stacks of articles and which enable the articles to be gravity fed. Means are provided for displacing the lowest article in each stack so that it projects from the stack and is easily grasped by the cashier.

9 Claims, 8 Drawing Figures

2
80
14
28
28
20
10
14
2
28
22
84
24
22
30
32
26
12

78
71
20
12

10
74
62
58
20
74
20
74
71
78
78
80
78

12
80
14
14
78
28

10
28
20
78
14
78
26
28
66'
30
25
22
22
25
27

OVERHEAD CIGARETTE RACK

BACKGROUND OF THE INVENTION

This invention relates to article display and vending devices which typically are usable in retail stores to display cigarette packages or other similarly packaged, stackable articles, for example, soap, photographic film, etc.

Retail stores and particularly supermarkets display for sale at the check-out counter a variety of items including cigarettes. A number ot types of cigarette display and vending racks have been used. In the most common type of installation, the rack is a simple cabinet having a number of vertical dividers which define a plurality of parallel vertical slots in which the cigarette packages may be stacked. The rack often is placed on the check-out counter facing the customer and facing away from the cashier. Experience has indicated a very high rate of pilferage from these devices. In addition, they are limited in size for a number of reasons, one of which being that if made too large the rack may obstruct the cashier's view. Thus, the typical self-service type of cigarette rack holds relatively few packages of cigarettes and must be replenished often. Also, because of the generally small size of the rack, the variety of cigarette brands often must be limited.

Pilferage is a substantial problem and a number of efforts have been made to locate cigarette racks remotely from the customer, for example, by placing a cigarette rack on top of the cash register where it can only be reached by the cashier. This type of installation also presents some difficulties. For example, a rack so located sometimes is difficult and awkward to refill because it may be difficult to reach. In addition, placement of the cigarette rack over the cash register obstructs a substantial portion of the cashier's view. Also, such racks are quite limited in size, for example, to the width of the register.

In addition to the above, prior racks have presented still further difficulties. For example, it is not uncommon for an entire stack of cigarettes to fall out of its vertical channel. Also, with typical prior art cigarette racks, each vertical channel is dimensioned to receive only one size of cigarette package (e.g., "regular", "king size", or "one hundred millimeter length"). This requires some care in loading the rack to assure that the correct size cigarette package is placed in the proper vertical channel. It is somewhat of a nuisance and is time consuming. Also among the difficulties is that when the bottom package in the stack is withdrawn from the rack it sometimes happens that more than one package is drawn out. This is somewhat inconvenient and, in some instances, the disruption at the bottom end of the stack can cause the entire stack to become unstable and fall out of its vertical channel.

It is among the objects of the invention to provide an improved display and vending device which overcomes the foregoing and other difficulties.

SUMMARY OF THE INVENTION

The device may be formed in one or more sections which may be arranged in a straight line, L-shaped configuration or otherwise as desired. Each section has a generally rectangular frame which is suspended overhead from the ceiling structure. The frame extends generally parallel to the check-out counter and above the inside edge of the counter. The side which faces the customer is closed by a transparent panel to enable the customer to see the articles in the device. The other side of the frame, which faces the cashier is open to enable the device to be filled and to enable easy withdrawal of the articles by the cashier. A plurality of vertical dividers are horizontally spaced within the frame and extend from top to the bottom to define a plurality of vertical article-receptive channels. A supporting shelf rests on the bottom of the frame inside the device and defines a platform for the lowest article in each vertical stack, the remaining articles in each vertical channel being stacked one atop each other. The shelf has inclined surfaces which tilt the lowest aticle and, therefore, the rest of the articles in the stack to retard their falling out or being drawn outwardly with the lowest article in the stack. The shelf also includes a lip having a plurality of spaced cut-outs therein, there being one cut-out associated with each vertical channel. The lip facilitates retention of a variety of sizes of cigarette packages and the cut-outs facilitate easy grasping of the individual bottom package in the stack. Each frame also has associated with it, at the open face thereof, a horizontally extending bar located above the support shelf to insure that the cigarette packages or other articles will be in proper alignment as they gravitate toward the shelf.

It is among the objects of the invention to provide an improved display and vending rack.

A further object of the invention is to provide an improved check-out counter configuration for a retail type of establishment embodying an improved overhead display and vending rack.

Another object of the invention is to reduce pilferage of cigarettes or the like at the check-out region of a retail store.

A further object of the invention is to provide a display and vending rack which has a substantially increased capacity.

Another object of the invention is to provide an article display and vending rack which is easy to load and in which removal of the individual articles is facilitated.

A further object of the invention is to provide a vending rack for stackable articles which displays the articles to the customer but which does not permit the customer to actually reach the articles.

Another object of the invention is to provide a cigarette vending and display rack which can accommodate substantially all commercially available lengths of cigarette packages.

A further object of the invention is to provide a display and vending device for use in the cashier region of a retail establishment which does not obstruct the cashier's view.

Another object of the invention is to provide an improved display and vending rack in which any of the vertical channels can receive substantially any size or brand of commercially available cigarette packages.

Still another object of the invention is to provide an improved display and vending device which results in more usable space at the counter level of a check-out counter.

DESCRIPTION OF THE DRAWINGS

The foregoing and other objects and advantages of the invention will be understood more fully from the following further description thereof, with reference to the accompanying drawings wherein.

DESCRIPTION OF THE PREFERRED EMBODIMENT

Figure 1:
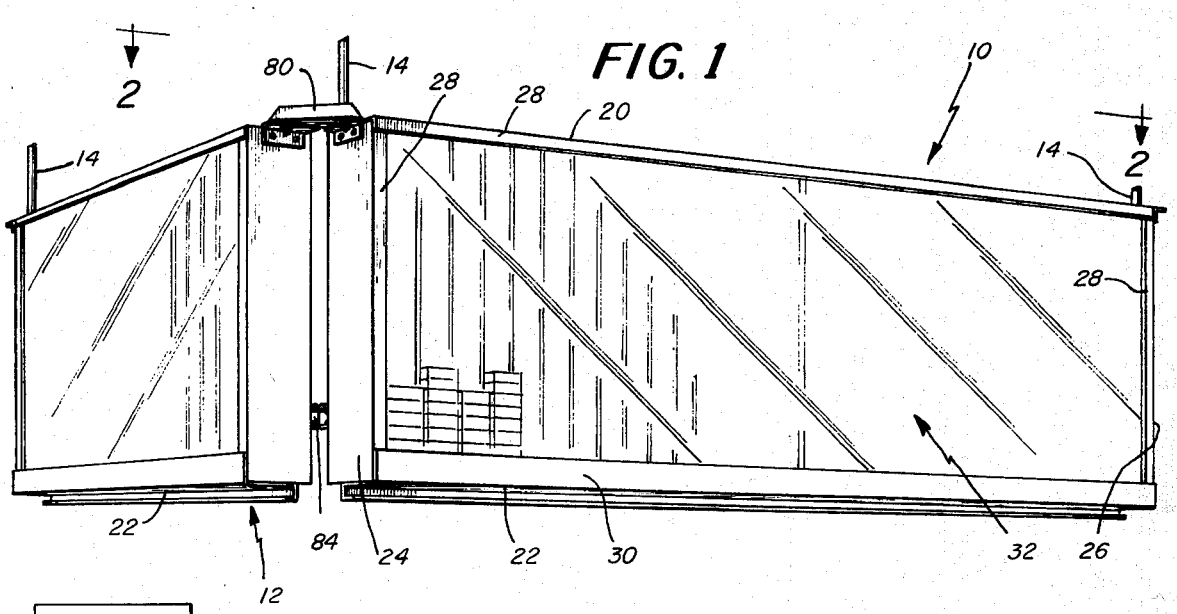
FIG. 1 is an illustration of an L-shaped display and vending rack as might be seen by the customer.
Figure 8:
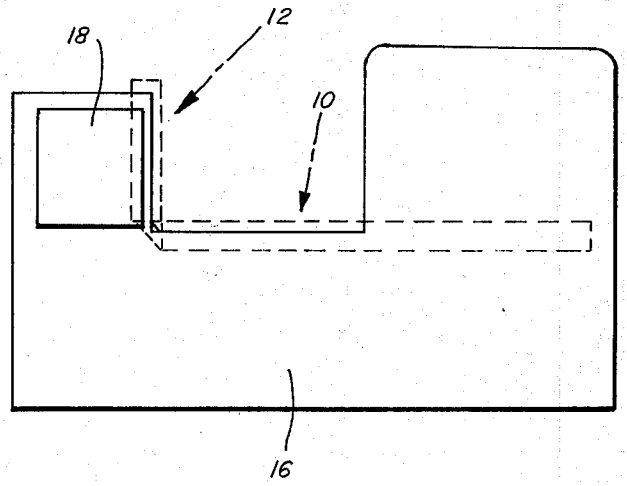
FIG. 8 is a somewhat diagrammatic plan illustration of a typical check-out counter employing the invention.

FIGS. 1 and 8 show an embodiment of the invention and the manner in which it may be installed with respect to a typical check-out counter, for example, as in a supermarket. FIG. 1 shows an embodiment in which the device is formed from two sections 10, 12 which are suspended overhead from the ceiling structure by suspension rods 14. The sections 10, 12 are substantially identical in construction except that in the embodiment shown the section 10 is longer than the section 12. As shown, sections 10, 12 may be supported in an L-shaped configuration. FIG. 8 illustrates, diagrammatically, a desired relative location in plan, of the rack with respect to a typical check-out counter as is found in a supermarket. The generally L-shaped check-out counter shown includes the counter portion 16 on which the cash register 18 is placed. The sections 10, 12 of the device similarly are arranged in an L-shaped configuration and are suspended so that they extend along the inside regions of the check-out counter, where the cashier is located. The sections 10, 12 are suspended at an elevation in which the bottom of the sections 10, 12 are well above the cashier's head so that they do not obstruct the cashier's view.

Figure 2:
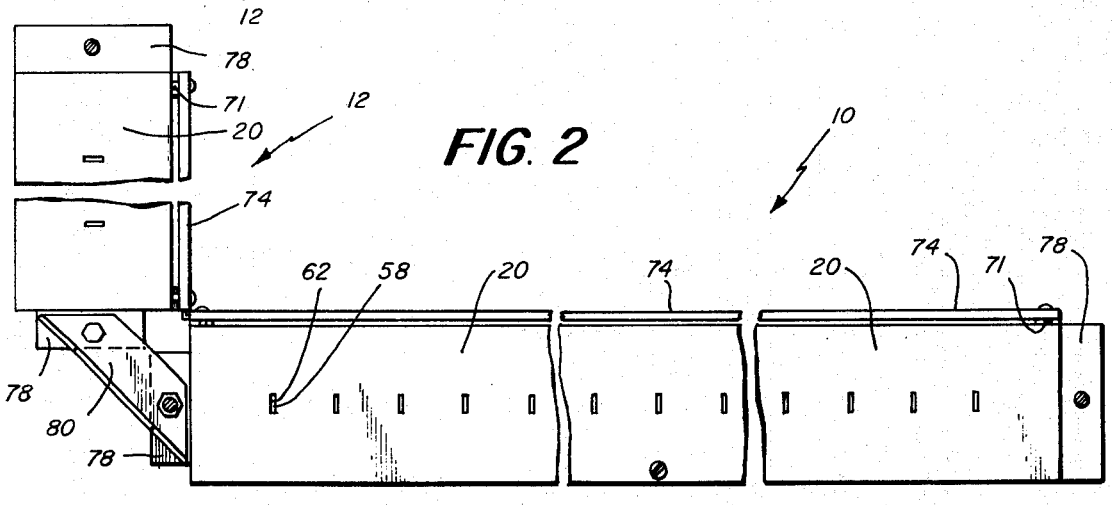
FIG. 2 is a segmented plan illustration of the rack shown in FIG. 1.
Figure 3:
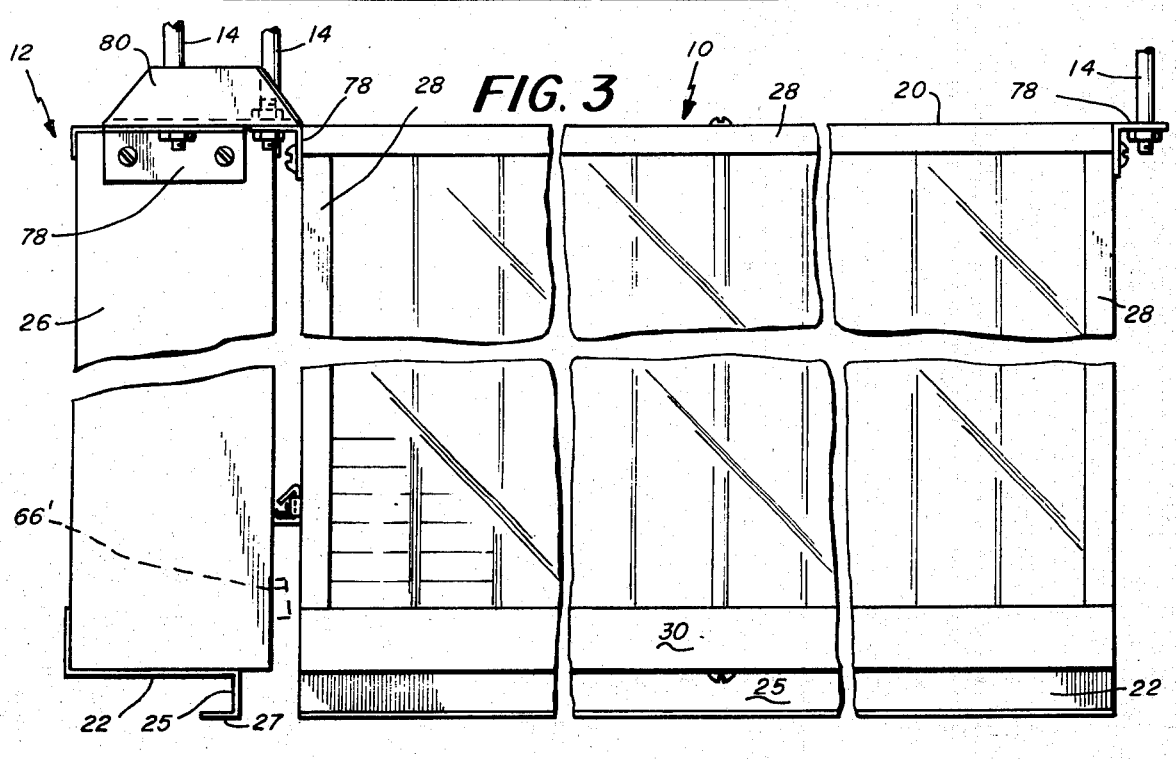
FIG. 3 is a front elevation of the device as seen from the customer's side.
Figure 4:
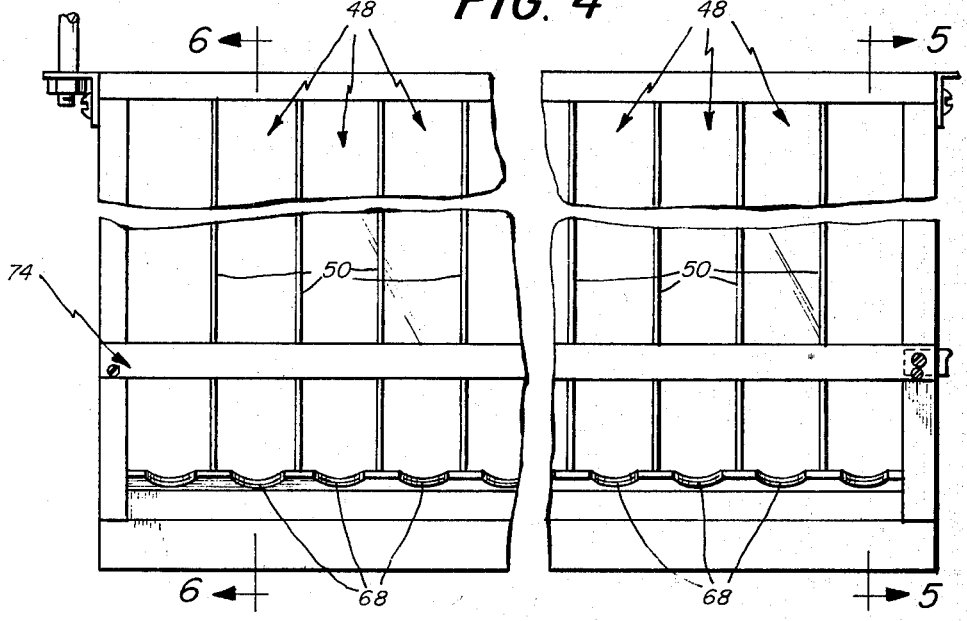
FIG. 4 is an elevation of the device as seen from the cashier's side.

As shown in FIGS. 2, 3 and 4 each of the sections includes a generally rectangular frame defined by an upper frame section 20, a lower frame section 22 and a pair of side frame sections 24, 26, all of which preferably are fabricated from sheet metal. For ease in description, the frame will be considered as having an outwardly or rearwardly facing side (the side facing the customer as seen in FIG. 1) and an inwardly or forwardly facing side (as would be seen by the cashier). The upper and side frame sections 20, 24 and 26 are of generally channel-shaped cross-section having flanges 28 extending longitudinally along their edges. The lower frame section 22 also has a flange 30 extending longitudinally and upwardly along its outwardly disposed edge. The frame sections 20, 22, 24 may be joined together where they meet at the corners by appropriate sheet metal fastening techniques. The outward face of each section is covered by a transparent panel (e.g., plastic) 32 which fits whithin the frame and is retained by the flanges 28, 30. The transparent panel 32 serves as a completely closed rear wall but enables the customer to view articles carried in the section.

Figure 5:
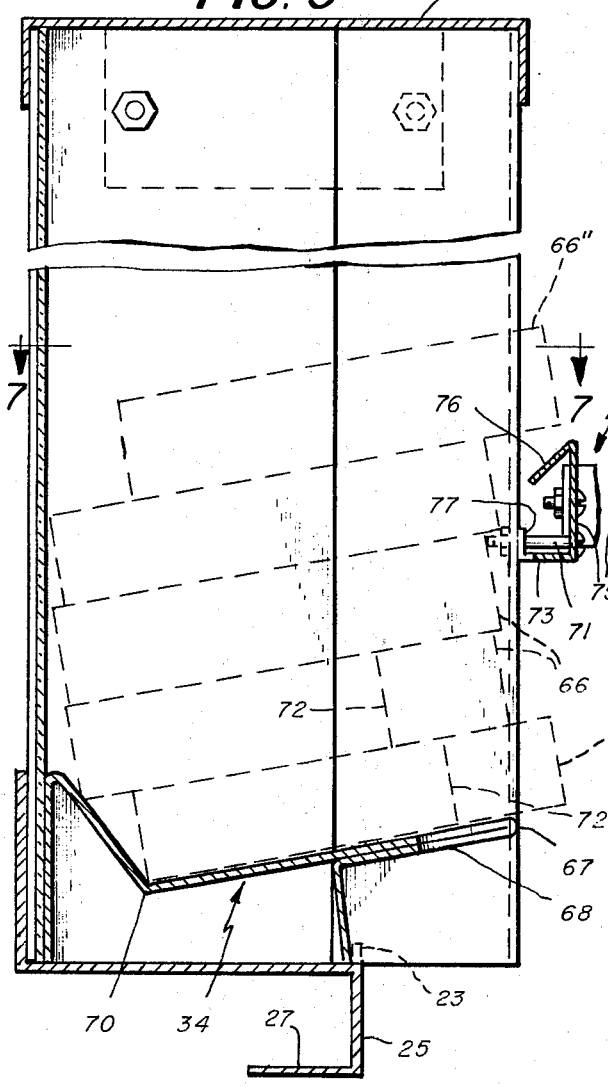
FIG. 5 is a side elevation of an end portion of the frame of the device as seen along the line 5—5 of FIG. 4.
Figure 6:
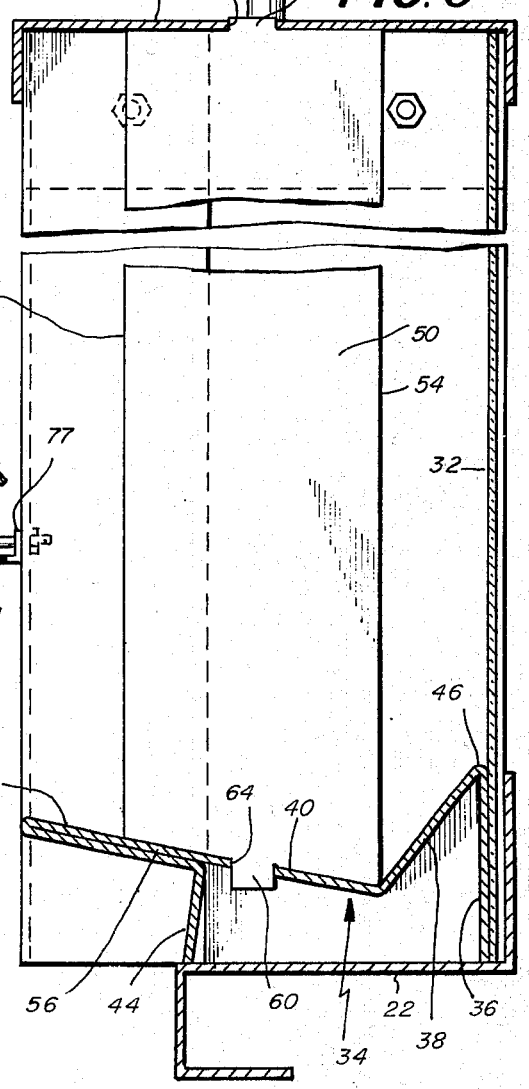
FIG. 6 is a sectional elevation of the device as seen along line 6—6 of FIG. 4.
Figure 7:
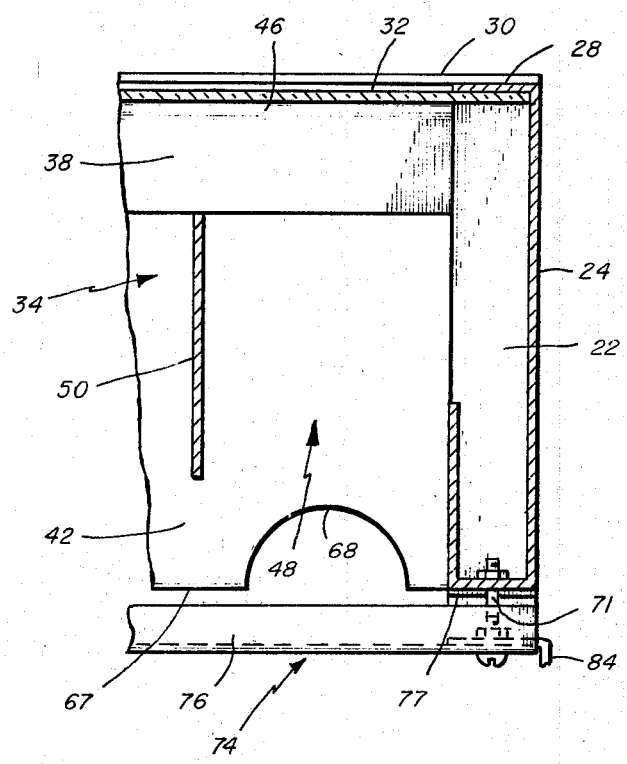
FIG. 7 is a partial plan sectioned illustration of the device as seen along line 7—7 of FIG. 5.

The articles to be displayed and sold, such as cigarette packages, are exposed on the cashier's side of the panel 32 and are supported on a transversely extending shelf, indicated generally at 34 in FIGS. 4–6. The shelf 34 extends the full width of the section, from one of the side frame sections 24 to the other 26. The shelf 34 is generally concave, or V-shaped and also is fabricated from sheet metal bent to define (as seen in cross section) a rear leg 36, a downwardly and forwardly inclined rear shelf portion 38, a forwardly and upwardly inclined front shelf portion 40, a reverted forwardly and upwardly inclined lip 42 and a downwardly extending front leg portion 44. The configuration of these parts of the shelf 34 is such that the junction 46 of the rear leg 36 and rear shelf portion 38 is disposed above the other portions of the shelf 34. The rear shelf portion 38 preferably makes an angle with the rear leg portion 36 of no more than approximately 45°, and the front shelf portion 40 and extension defining the lip 42 make an angle with the rear shelf portion of at least more than 90° and, preferably of the order of 120°. The shelf 34 is self supporting in the device and the rear leg 36 bears against the inwardly facing surface of the transparent panel 32 to retain the panel in place. The legs 36, 44 bear directly on the lower frame section 22. Also, the shelf 34 preferably is constructed so that the outermost edge of the lip 42 lies below the height of the juncture 46. As will be described, the configuration of the support shelf 34 serves to present the lowermost pack of cigarettes to the cashier in a manner which facilitates its removal.

The lower frame section 22 may have, at its forward edge, an upwardly extending lip, indicated in phantom at 23 in FIG. 5, to engage the leg portion 44 of the shelf. Alternatively, the lip 23 may be omitted and the forward edge of the lower frame section 22 may have a channel-shaped extension depending therefrom, as defined by panels 25 and 27, shown in solid in FIG. 5. This latter configuration further strengthens the structure.

The interior of the rectangular section 10 is divided into a plurality of vertically extending channels indicated generally by the reference character 48 to separate the vertical stacks of articles from each other. The vertical channels 48 are defined by a plurality of dividers 50 which extend from the upper frame section 20 downwardly to the shelf 34. The dividers 50 may also be fabricated from sheet metal having vertical front and rear edges 52, 54 (FIG. 6) and a lower edge 56 which is inclined downwardly and rearwardly and rests on the front shelf portion 40 of the shelf 34. The dividers are retained in place by means of tabs 58, 60 which extend through forwardly-rearwardly extending slots 62, 64 formed in the upper frame section 20 and front shelf portion 40, respectively. By way of example, a typical section may include 24 vertical channels 48. In the embodiment shown the dividers 50 are evenly spaced and the channels 48 which they define of equal width.

This configuration is suited particularly for use in connection with vending of cigarette packages which, typically, all are of substantially the same width and thickness. Cigarette packages, however, do differ in length and a number of cigarette lengths are commercially available such as "regular size" (approximately 70 millimeters), "king size" (approximately 85 millimeters) and "100 millimeter" size. The invention is able to accommodate any of these sizes in any of the vertical channels 48. The depth of the channel and, particularly, the configuration of the shelf 34 are such that the smallest length package will be easily accessible while the longest length package will not protrude excessively from the device. FIG. 5 illustrates the manner in which the cigarette packages, indicated in phantom at 66, may be stacked within one of the channels 48. The lowermost package, indicated at 66', will protrude well beyond the other packages in the stack sufficiently so that it can be grasped easily by the cashier. This results from the configuration of the shelf 34. As it can be seen from FIG. 5, when the lowest package 66' is removed, the remaining packages in the stack above will fall of their own weight. The rear shelf portion 38 which is inclined forwardly and downwardly will guide the lowest package in the stack forwardly to the position suggested at 66'. The lowest pack 66' which rests on the shelf portion 40 and lip portion 42 is supported so that its forward end is in a forwardly and upwardly inclined attitude which causes the remaining packages stacked above also to assume the inclined attitude suggested in FIG. 5. That attitude tends to preclude the cigarette packages from falling out of the channels 48 in that each of them tends to slide downwardly and rearwardly toward and against the transparent rearward wall 32.

The forward shelf portion 40 and forwardly extending lip 42 are sufficiently deep (as measured from the forward edge 67 of the lip to the juncture 70 of shelf portions 38 and 40) to be able to provide a firm support surface for the full range of package sizes. As illustrated, the depth of the shelf portion 40 and lip 42 is greater than the length of "regular" size cigarette packages but is less than the length of "100 millimeter" size cigarette packages.

In order to be able to easily grasp all of the commercially available sizes of cigarette packages, the lip 42 is provided with a plurality of cut-out regions 68, there being one cut-out associated with each vertical channel 48. The cut-out region 68 is sufficiently deep so that when even the smallest length of cigarette package is supported on the shelf 34 (with its lower rearward corner disposed at the corner 70 of the shelf 34) the forwardmost end of the lowest cigarette package 66' will project forwardly beyond and overlap the cut-out 68 as suggested in phantom at 72' in FIG. 5. The reference character 72 illustrates the location of the forwardmost end of the next adjacent cigarette pack in the stack.

The invention also includes a horizontal aligning bar indicated at 74 mounted to the front side of the device above the shelf 34 and extending transversely across the entire width of the device. The horizontal bar 74 is secured by appropriate means to the side frame sections 24, 26. The bar 74, is employed to urge any of the cigarette packages in the stack which may be protruding too far forwardly, back into the device to maintain the stability of the stack and also to insure that the cigarette packages will engage the shelf 34 and be properly positioned on the shelf 34 for removal. To this end, the horizontal bar 74 includes a downwardly and rearwardly inclined flange 76 which extends from the upper edge of the bar as shown. As indicated at 66'', a cigarette package which may have been improperly placed in the device and which extends too far forwardly will engage the bar and will be guided back into the channel as the package 66'' slides along the flange 76. The horizontal bar 74 also aids in rigidifying the device. The bar 74 may be secured to the frame, for example, at the side frame sections 24, 26 by bolts 71. The bar 74 may be fabricated from sheet metal and, in the illustrative embodiment, is bent along its length to define a bottom panel 73, a front panel 75, and the downwardly and rearwardly inclined flange 76. The transverse ends of the bottom panel 73 may have an upwardly extending tab 77 which bears against the forwardly facing flange 28 of the side frame sections 24, 26 to facilitate securing the bar 74 in place. The bolts 71 may be passed through aligned holes in the front panel 75 and tabs 77 as shown.

The device may be hung from an appropriate overhead support, such as the ceiling grid or ceiling structure, by brackets 78 secured to the side frame sections which receive suspension rods 14. Where two sections are arranged in an L-shaped configuration as shown it is desirable to connect the adjacent ends of the sections as by an additional bracket 80 connected to the upper ends of each of the sections 10, 12. If desired, an additional L-shaped connector bracket 82 may be passed through the adjacent channels defined by the bars 74 where those bars mate as suggested at 84 in FIG. 1.

The device is capable of handling a large inventory of cigarette packages encompassing the full range of commercially available cigarettes. In this regard, it may be noted that the frame section 10, for example, may be approximately 41 inches wide and 24 inches high and approximately 5½ inches deep. A section having these dimensions is capable of holding 24 different brands totalling approximately 650 individual packages. The total weight of such a substantial number of cigarette packages is significant and the construction of the device is such that it can hold such a load without deformation which might have an adverse affect on its operation.

While the invention has been described primarily in connection with a device for displaying and vending cigarette packages it should be understood that it is usable to display and vend other types of packages or articles. It will be appreciated that the invention enables a substantial number of articles to be displayed while enabling them to be readily available for sale. Moreover, these objectives are achieved without interfering with the cashier's view and in a manner which also results in increased usable counter space. In addition, losses from pilferage necessarily are significantly reduced.

It should be understood that the foregoing description of the invention is intended merely to be illustrative thereof and that other modifications and embodiments may be apparent to those skilled in the art without departing from its spirit.

Having thus described the invention, what I desire to claim and secure by Letters Patent is:

1. A display and vending device for use with generally rectangular, stackable articles, comprising:

a generally rectangular frame having top, bottom and side sections;

a transparent panel supported by said frame and defining a back wall;

a plurality of vertical dividers carried by the frame, the vertical dividers being spaced horizontally to define, in cooperation with the back wall, a plurality of vertical article-receptive channels;

a shelf carried by the bottom section of the frame and extending substantially between the side sections, the shelf defining the bottom of each of said vertical channels, the shelf being of generally V-shaped, concave configuration having a rearward portion which extends forwardly and downwardly and a forward portion which extends forwardly and upwardly, the forwardmost portion of the shelf defining a lip extending forwardly of the dividers, and a plurality of cutout portions formed in the lip, the cutout portions being spaced along the lip there being one cutout portion associated with each of the vertical channels;

a horizontally extending bar mounted to the frame on the forwardly facing side thereof and extending from one side section to the other, the horizontal bar being disposed above the forwardly extending lip portion of the shelf and being disposed to engage articles stacked in any of the channels which may protrude forwardly beyond said bar and to urge said articles fully back into said channel as said stack of articles advances downwardly;

said V-shaped shelf being constructed so that the lowermost article in a stack thereof will protrude forwardly beyond those of the stacked articles below the horizontal bar.

2. A device as defined in claim 1 wherein said horizontal bar includes a flange extending downwardly and rearwardly from the upper edge of said bar.

3. A device as defined in claim 2 wherein said flange on said bar is inclined at an angle of approximately 45° to the horizontal.

4. A device as defined in claim 1 wherein the depth of said shelf, as measured from the juncture of the forward and rearward portions thereof to the forward edge of said lip is no more than approximately 100 millimeters.

5. A device as defined in claim 1 wherein the depth of the forward portion of said shelf, as measured from the juncture of the rearward and forward portions of the shelf and the most rearward portion of the cutouts is less than 70 millimeters.

6. A device as defined in claim 1 wherein said shelf further comprises:

a length of sheet metal bent to define a plurality of continuous portions including a rear leg portion, said rear shelf portion, said front shelf portion, said lip portion and a front leg portion, said rear leg portions and front leg portions resting on top of the bottom frame section and being dimensioned to support said shelf portions and lip above the bottom frame section, the juncture of said rear leg portion and rear shelf portion being disposed above the level of the forwardmost edge of the lip portion of the shelf.

7. A device as defined in claim 6 wherein said rear shelf portion is inclined to the vertical at an angle of approximately 45° and wherein the forward shelf portion is inclined with respect to said rear shelf portion at an angle of approximately 120°.

8. A device as defined in claim 1 wherein each of said vertical dividers further comprises:

a flat sheet having a tab protruding at each of its upper and lower ends;

the top section of said frame and the shelf each having a plurality of transversely spaced slots formed therein to receive, respectively, the upper and lower tabs of said dividers.

9. A device as defined in claim 1 further in combination with a check-out counter and further comprising:

said check-out counter being elongate and having a forward, cashier side and a rearward, customer side;

said frame being suspended from an overhead support above the check-out counter and at a location which is disposed nearer the forward side of the check-out counter than the rearward side thereby to preclude a person on the rearward side of the check-out counter from reaching the forward side of the display and vending device;

said display and vending device being suspended at an elevation in which the bottom section thereof is sufficiently high as to present no obstruction to the cashier's view.

* * * * *